US009260862B2

(12) United States Patent
Cooper et al.

(10) Patent No.: US 9,260,862 B2
(45) Date of Patent: Feb. 16, 2016

(54) BEVELED TRENCH FORMING DEVICE FOR CONCRETE SLAB FOUNDATIONS

(75) Inventors: Marvin Octavious Cooper, Houston, TX (US); Don Arland Shelton, Houston, TX (US)

(73) Assignee: Eveth Cooper, Houston, TX (US)

( * ) Notice: Subject to any disclaimer, the term of this patent is extended or adjusted under 35 U.S.C. 154(b) by 663 days.

(21) Appl. No.: 11/409,593

(22) Filed: Apr. 24, 2006

(65) Prior Publication Data

US 2007/0259520 A1 Nov. 8, 2007

(51) Int. Cl.

| | |
|---|---|
| ***E04B 5/19*** | (2006.01) |
| ***E04G 13/00*** | (2006.01) |
| ***E04B 5/40*** | (2006.01) |
| ***E04B 5/32*** | (2006.01) |
| ***E02D 27/01*** | (2006.01) |
| ***E02D 27/02*** | (2006.01) |

(52) U.S. Cl.

CPC . *E04B 5/19* (2013.01); *E02D 27/01* (2013.01); *E02D 27/02* (2013.01); *E04B 5/326* (2013.01); *E04B 5/40* (2013.01); *E04G 13/00* (2013.01)

(58) Field of Classification Search

CPC ..... E04G 13/00; E04B 5/40; E04B 5/326; E04B 5/19

USPC ..... 52/294, 443, 223.6, 414, 576, 745.02, 52/320, 323; 405/229

See application file for complete search history.

(56) References Cited

U.S. PATENT DOCUMENTS

| | | | | | |
|---|---|---|---|---|---|
| 1,183,594 | A * | 5/1916 | Robinson | 264/32 |
| 2,775,019 | A * | 12/1956 | Bemis | 249/30 |
| 3,495,367 | A * | 2/1970 | Kobayashi | 52/223.6 |
| 3,503,583 | A * | 3/1970 | Emerson et. al. | 249/176 |
| 3,543,458 | A * | 12/1970 | Guritz | 52/127.3 |
| 3,632,078 | A * | 1/1972 | Dashew | 249/183 |
| 3,640,040 | A * | 2/1972 | MacLean et al. | 52/337 |
| 3,695,574 | A * | 10/1972 | Charlier et al. | 249/175 |
| 5,526,623 | A * | 6/1996 | Bullivant | 52/338 |
| 5,540,524 | A * | 7/1996 | Gonsalves | 405/257 |
| 5,934,036 | A * | 8/1999 | Gallagher, Jr. | 52/323 |
| 7,028,445 | B2 * | 4/2006 | Camilleri | 52/742.14 |
| 2006/0075707 | A1 * | 4/2006 | Cretti | 52/414 |
| 2007/0259520 | A1 * | 11/2007 | Cooper et al. | 438/653 |

* cited by examiner

*Primary Examiner* — Andrew J Triggs

(57) ABSTRACT

An assemblage which form a beveled edge in a slab-on-grade foundation trench. The device is comprised of straight members corner members, and a connector member to hold the larger members together, an angle brace to maintain the proper bevel angle of 45° degrees, and a stake to anchor the device to the ground. When the device is assembled it forms a box-like structure whose sides and corners are sloped inwards at a 45° degree angle. The device simply needs to be positioned within the perimeter form, and filled with dirt from digging the trench; in order for the device to properly function as a device designed to make foundations much stronger.

1 Claim, 11 Drawing Sheets

BEVELED TRENCH FORMING DEVICE FOR CONCRETE SLAB FOUNDATIONS

CROSS-REFERENCE TO RELATED APPLICATIONS

This application claims the benefit of provisional patent application Ser. No. 60/274,500 filed 2005 Apr. 26 by the present inventors

FEDERALLY SPONSORED RESEARCH

Not Applicable

SEQUENCE LISTING OR PROGRAM

Not Applicable

BACKGROUND OF THE INVENTION

1. Field of Invention

This invention relates to foundation trenches for buildings, specifically to such trenches that are required by certain building code standards to have a 45° degree bevel incorporated into the trench.

2. Prior Art

The present system of slab-on-grade construction requires the layout and construction of the perimeter form, which is then filled with fill-dirt up to the height that will allow the proper slab thickness to be installed. The fill-dirt is neither packed or leveled. The trenches are dug, forming island-like, square or rectangular areas between the trenches. Dirt from the perimeter trenches is thrown outside the perimeter form. Dirt from the interior trenches is thrown on to the island which makes the island higher.

After the trenches are finished the island has to be lowered and leveled. Fill-dirt that was moved from the trenches to the islands has to be moved again; from the island to outside of the perimeter form. In the process of removing and leveling the fill-dirt, trenches frequently cave in.

Generally no effort is made to repair this widening of the trench. Additional traffic damage occurs when the foundation is covered with plastic film. The most serious traffic damage occurs when the metal reinforcement systems are installed. Falls and stumbling causes additional damage. Usually, no effort is made to cut or carve the code required 45° degree bevel into the foundation trench.

OBJECTS AND ADVANTAGES

The object of this invention is to overcome the shortcomings of the prior art, and to provide a very simple, lightweight and inexpensive means of installing a 45° degree bevel in a foundation trench. Accordingly, several objects and advantages are:

(a.) to provide a device that makes building foundations stronger.

(b.) to provide a device that makes foundation construction a faster process.

(c.) to provide a device that makes foundation construction an easier process.

(d.) to provide a device that makes foundation construction less expensive.

(e.) to provide an easily manufactured device.

Further objects and advantages are to provide compliance with the International Code Council rules. The International Code Council requires 45° degree bevels in slab-on-grade foundation trenches.

The foregoing may be summarized into four (4) primary objectives.

1. Comply with International Code Council rules requiring 45° degree beveled trenches
2. Make a stronger foundation
3. Save time
4. Save money

SUMMARY

In accordance with the present invention a material shaped to produce a cross-section profile of a hollow, opened end, "V" shaped wedge. The wedge being in one configuration horizontally elongate; and in the other configuration elbow shaped 90° degree outside corner. Said corners and elongated sections joined to produce a four sided enclosure whose sides form the bevel of a slab-on-grade foundation trench.

DRAWING

Figures

DRAWINGS

Reference Numerals

Figure 1:
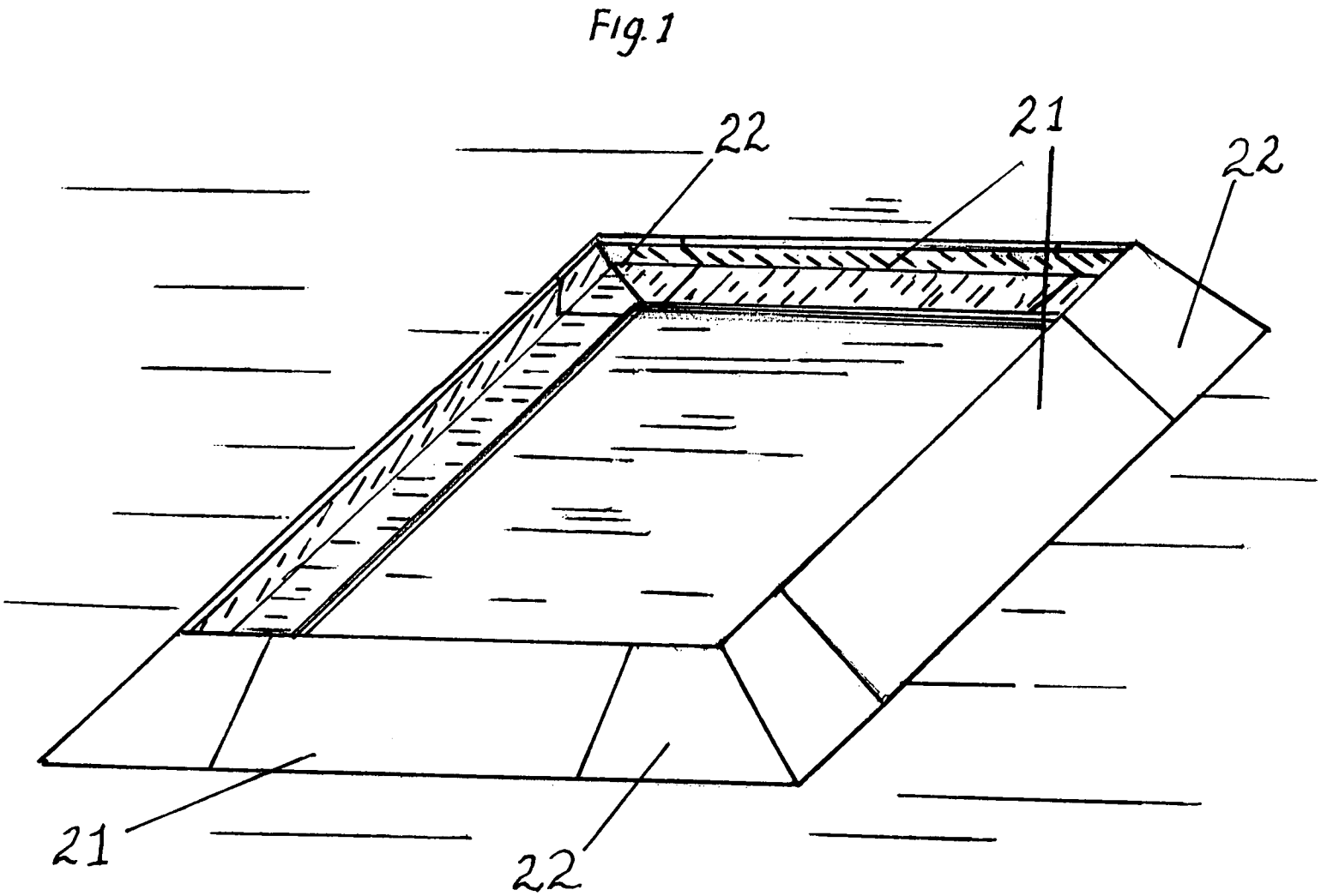
FIG. 1 is a perspective view of the assembled invention without the small parts.

In the following description the reference numerals in the drawings be noted to correspond with the following elements.

21 straight bevel member
22 corner
23 stake
23*b* "T" shaped slot
24 connector member
24*a* "T" shaped extension
25 angle brace member
25*a* "T" shaped extension
26 perimeter
27 undisturbed earth
28 earthen fill
29 cement

30 mixture of earthen fill and excavated earth from the beam trench

DETAILED DESCRIPTION

FIGS. 1-13—Preferred Embodiment

Figure 2:
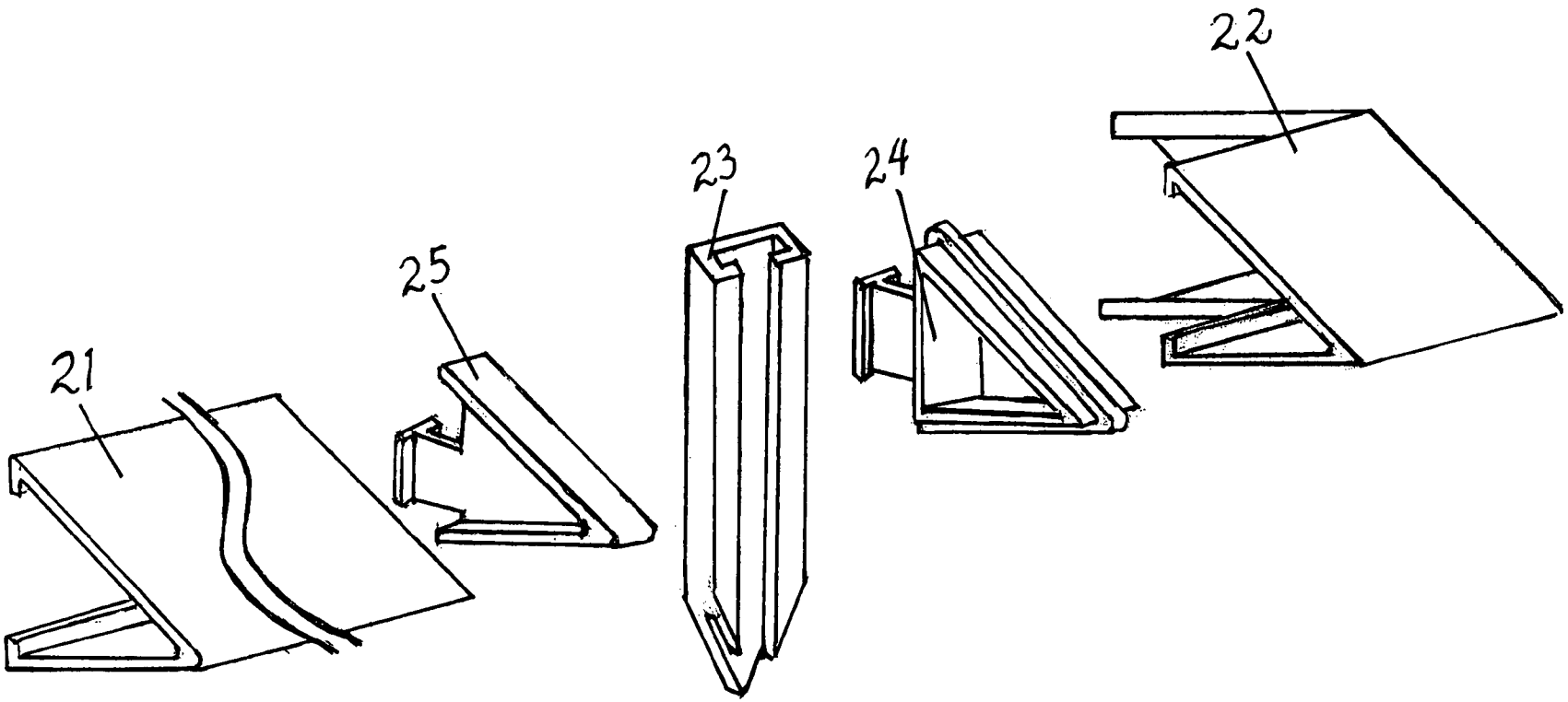
FIG. 2 is a perspective view of parts of the invention.

FIG. 1 shows a perspective view of bevel forming device without its small parts FIG. 2 shows a perspective view of the parts to said device with elongated section 21, corner member 22, stake 23, connector 24, angle brace 25

Figure 3:
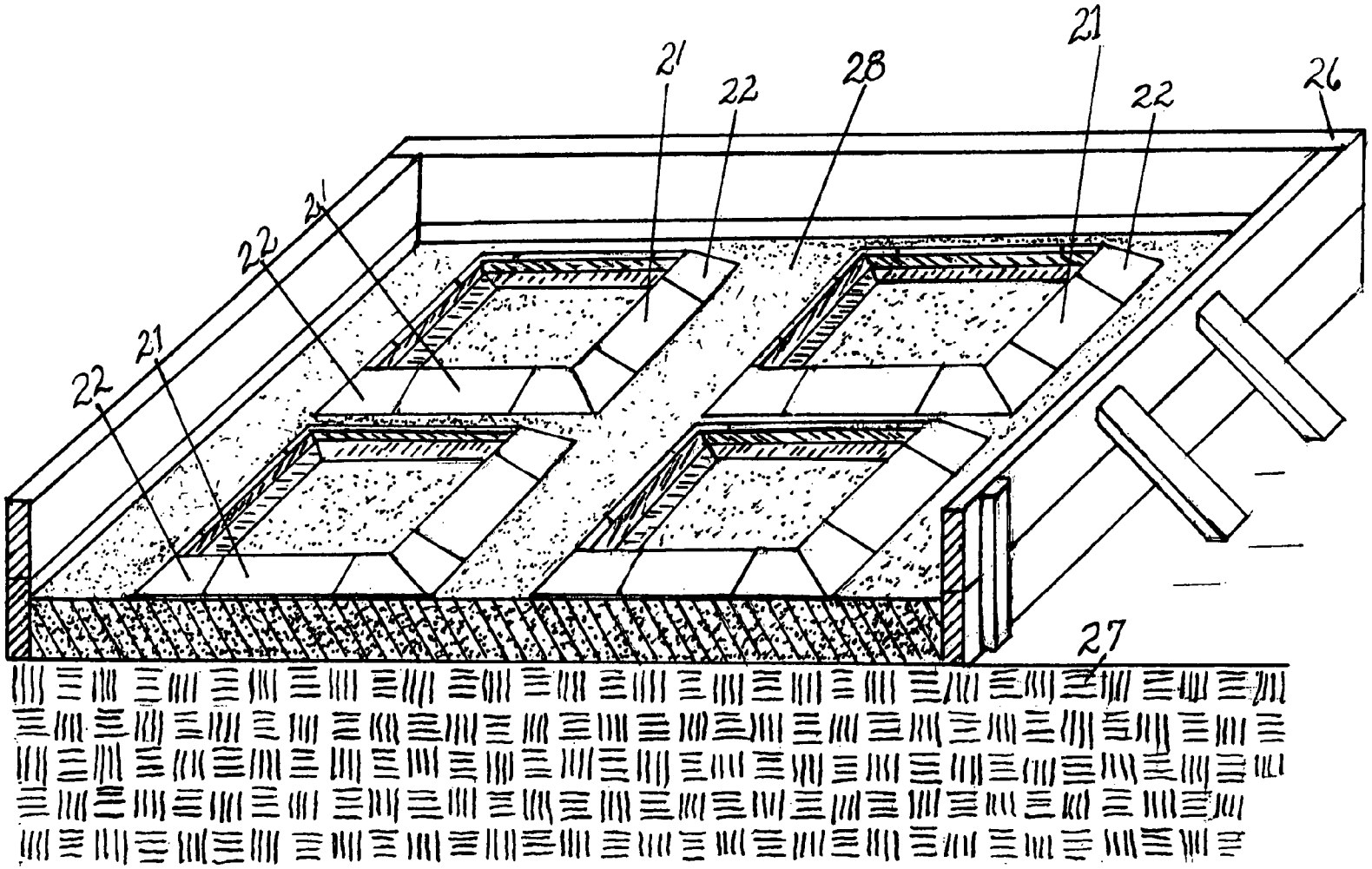
FIG. 3 is a perspective view of the invention laid out inside a perimeter form.
Figure 4:
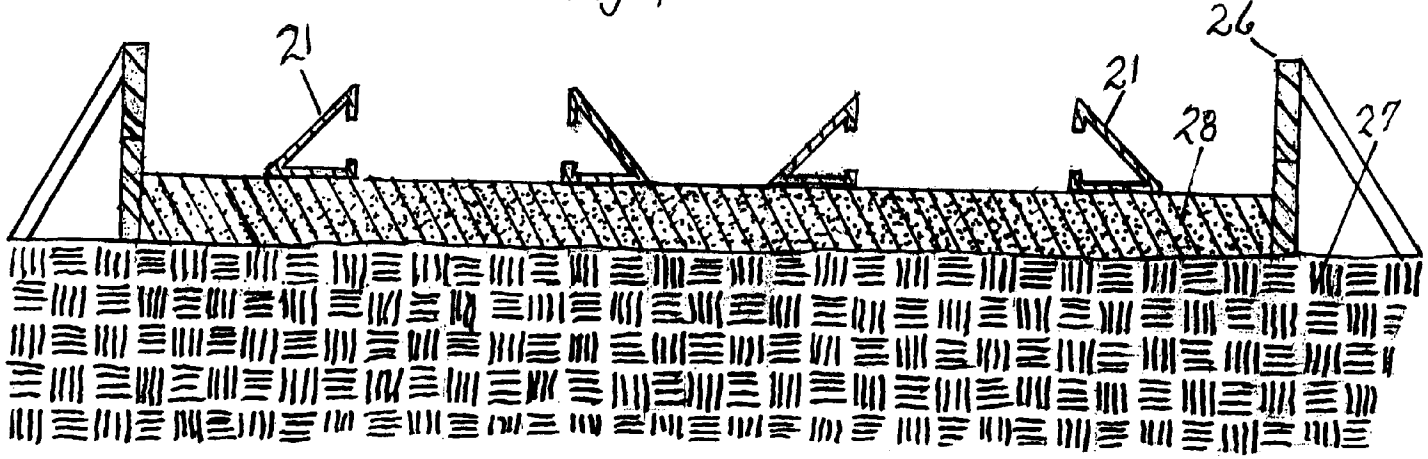
FIG. 4 is a cross-section of FIG. 3.

FIG. 3 shows a perspective view of the device installed in a foundation perimeter form 26, the sloped edge of said device will form the edge of the foundation trenches FIG. 4 show a cross-section view of the device installed in a foundation perimeter form. Said device installed on earthen fill 28 which sits on undistributed earth 27.

Figure 5:
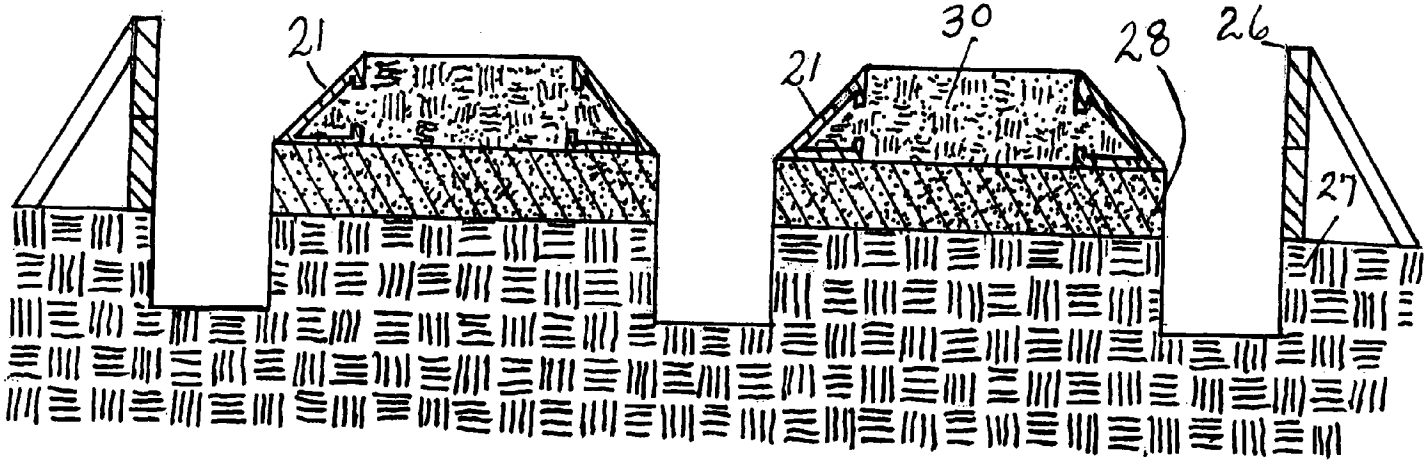
FIG. 5 is a cross-section view of the invention after the trenches have been dug, with the fill-dirt and previously undisturbed soil from digging the trenches being used to fill the inventions form.

FIG. 5 shows a cross-section view of the device after the trenches have been dug and the excavated fill-dirt 2 and excavated earth 27 are used to fill the entire volume of said device.

Figure 6:
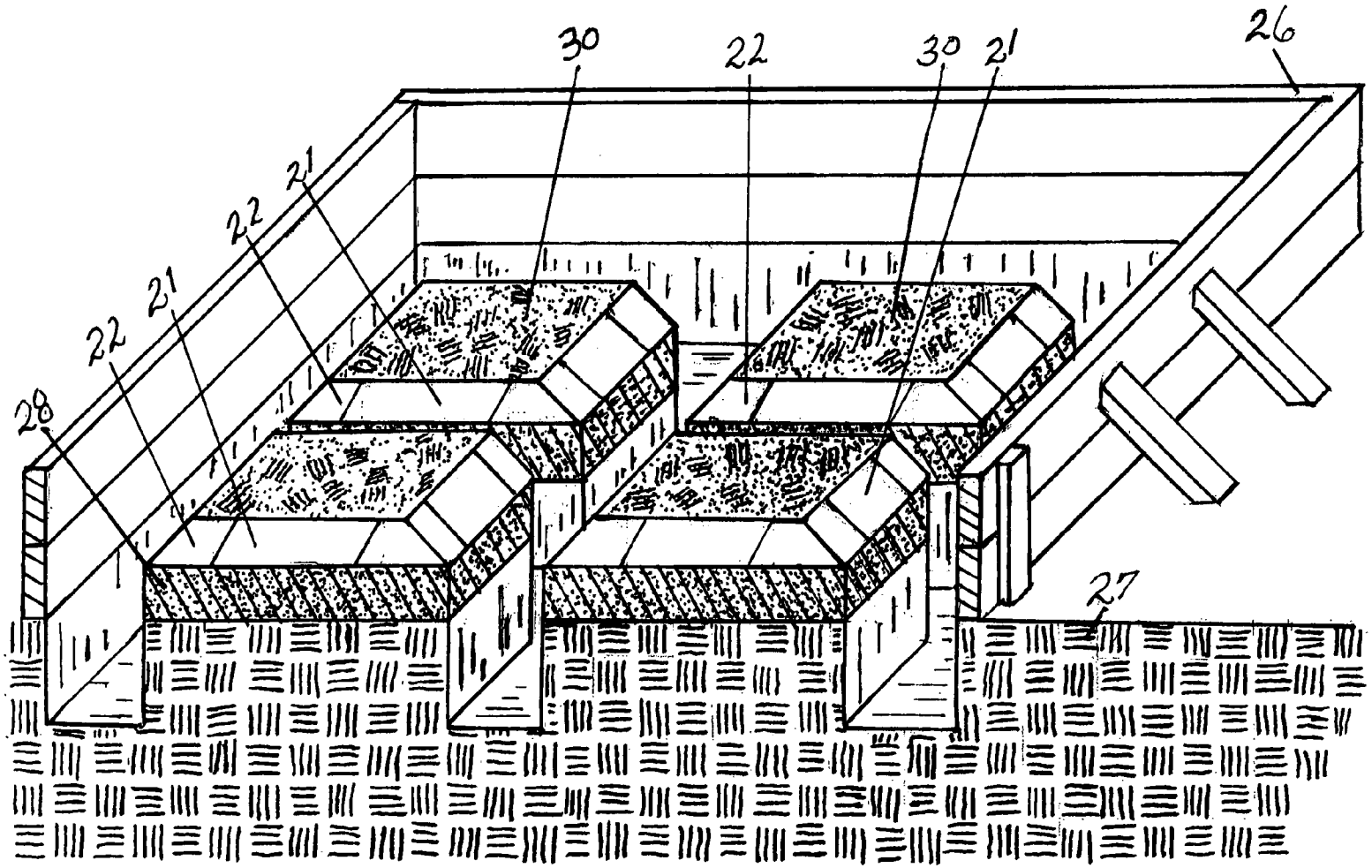
FIG. 6 is a perspective view of FIG. 5.

FIG. 6 shows a perspective view of FIG. 5. Fill-dirt 28, and previously undistributed soil 27, have been used as a mixture 30 to fill the entire volume of the device, said device is screeded.

Figure 7:
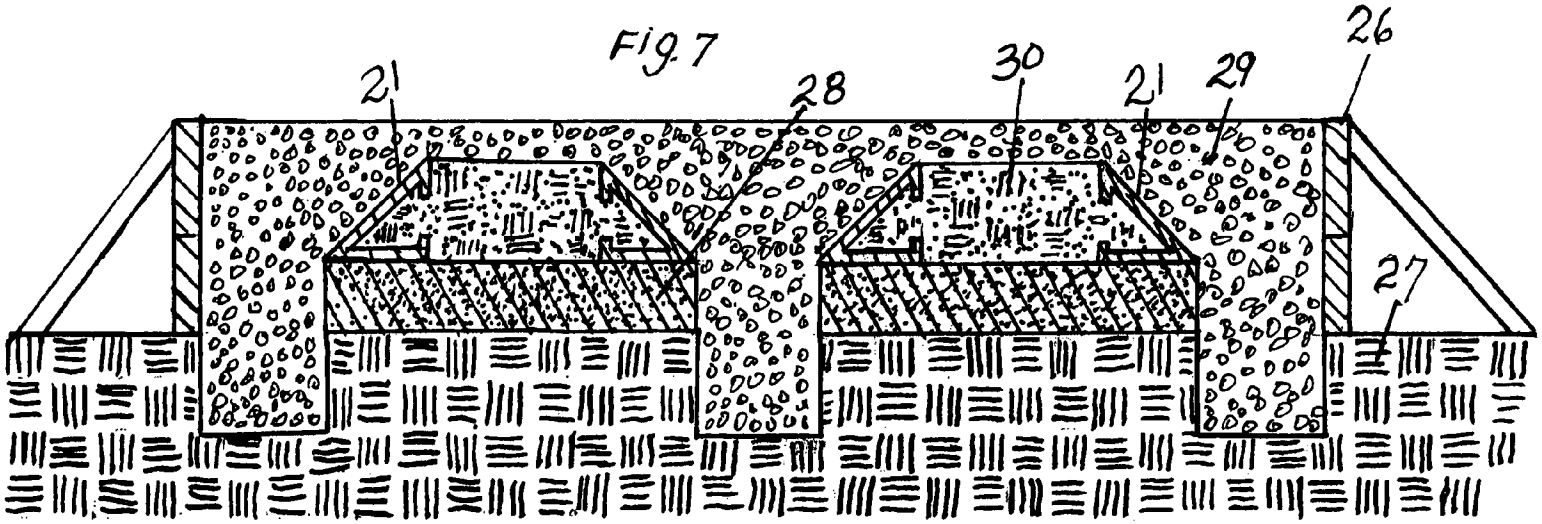
FIG. 7 is a cross-section view of the invention after the perimeter form has been filled with cement and screeded.

FIG. 7 shows a cross-section view of the entire foundation form after said form has been filled with cement 29.

Figure 8:
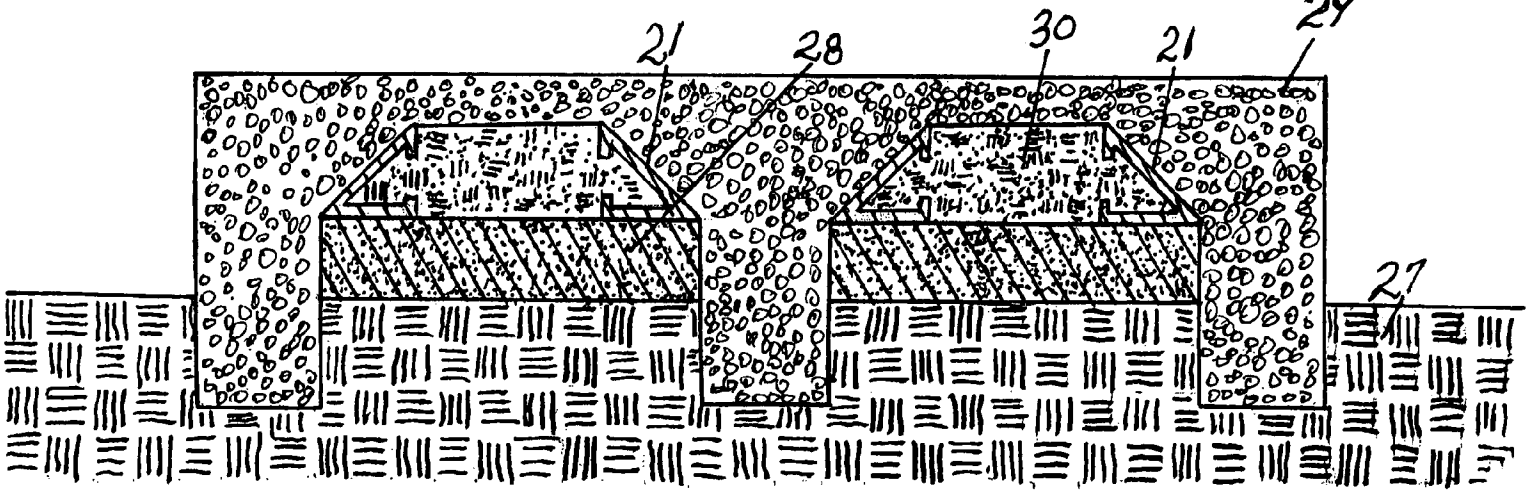
FIG. 8 is a cross-section view of the finished foundation after the perimeter forms have been disassembled.

FIG. 8 shows a cross-section view of the finished foundation after the cement 29 hardens and the perimeter form 26 had been removed.

Figure 9:
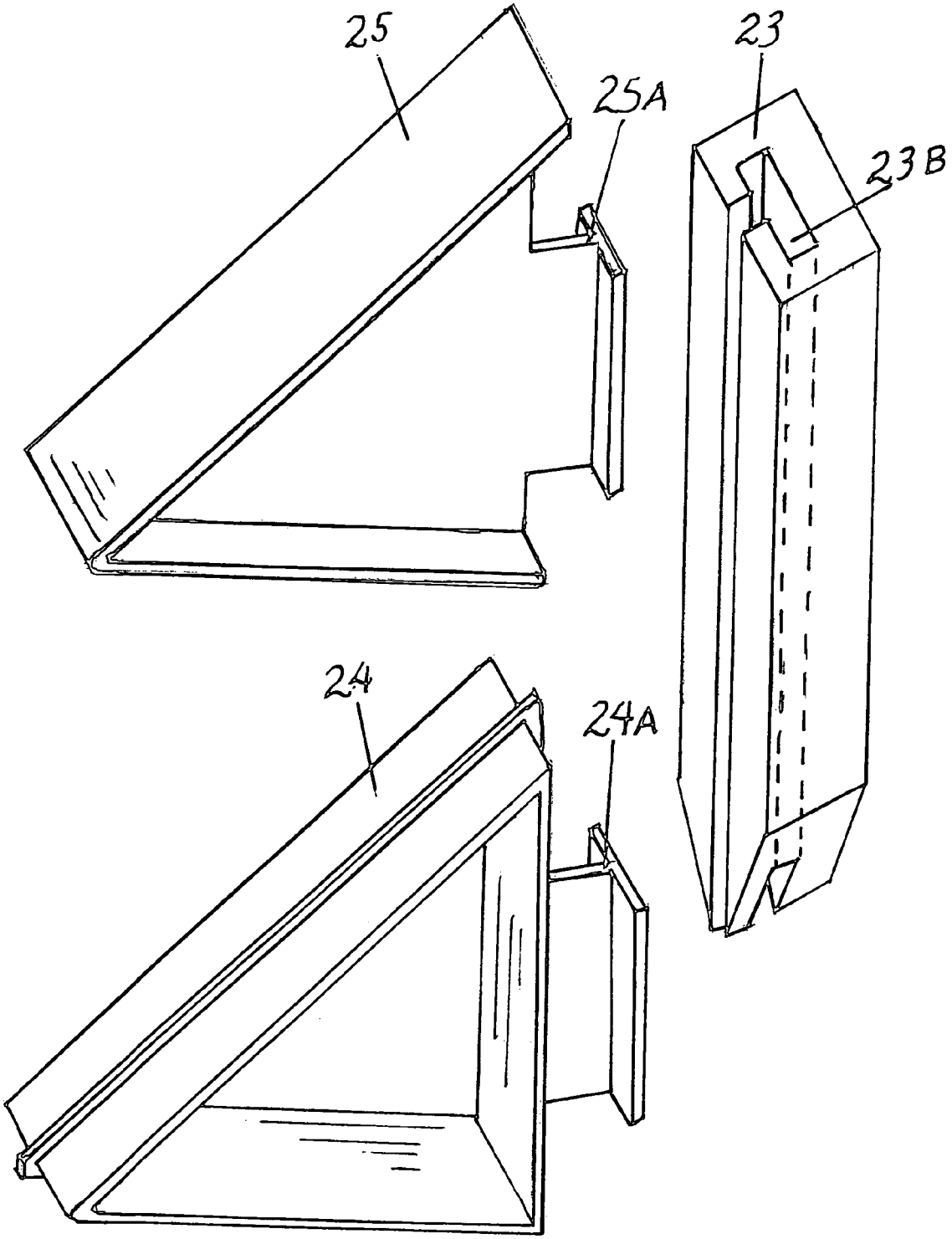
FIG. 9 is a perspective view of the connecting and bracing systems.

FIG. 9 shows a perspective view of the connector member 24, angle brace member 25 and the stake 23. The connector member 24 has a "T" shaped extension 24*a* on the vertical leg of the connectors member 24. The angle brace member 25 also has a "T" shaped extension 25*a*. Both "T" shaped extensions 24*a* and 25*a* are designed to interlock with the "T" shaped slot 23*b* of the stake 23.

Figure 10:
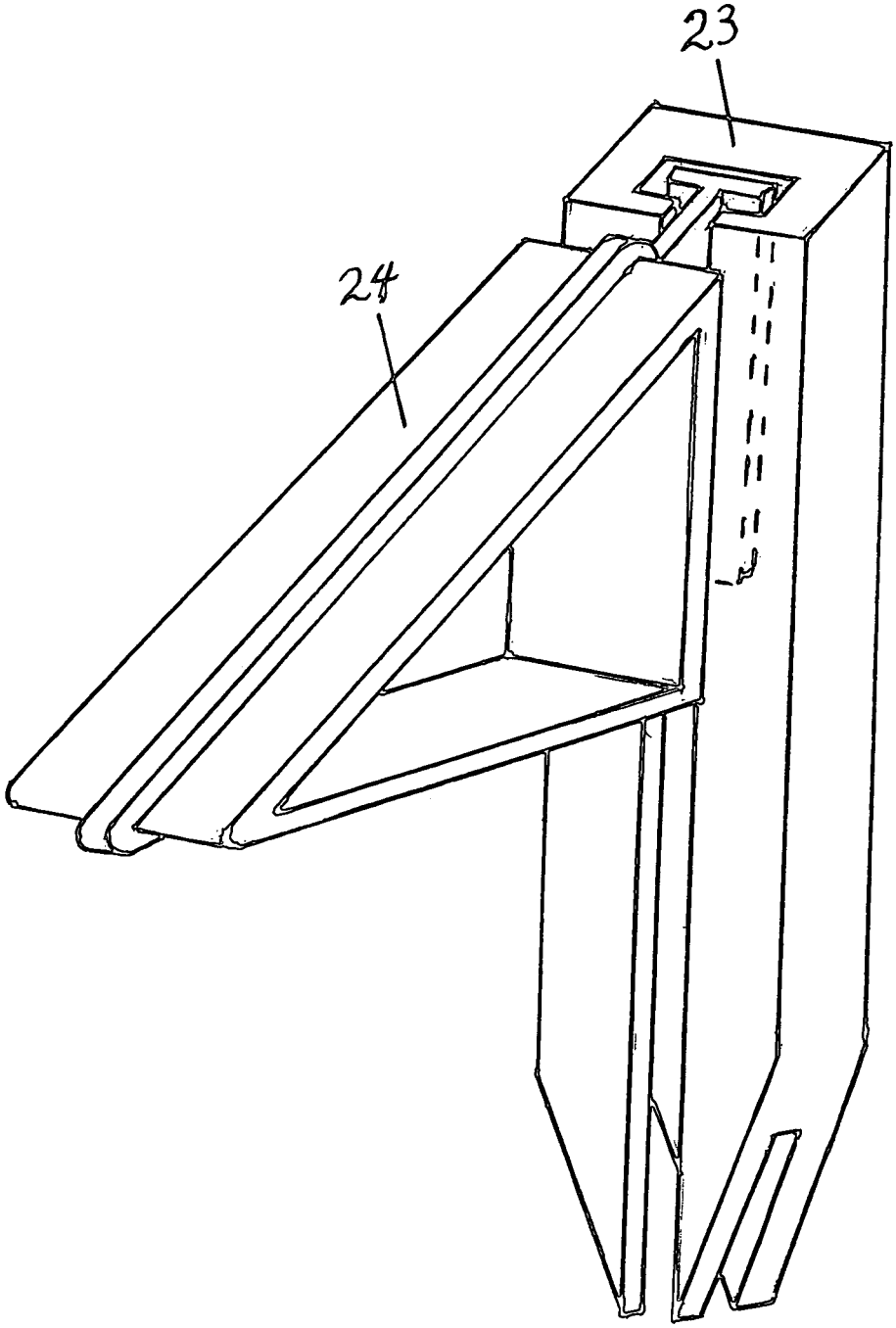
FIG. 10 is a perspective view showing how the brace and connectors work with the stake.

FIG. 10 shows a perspective view of the connector member 24 with said connectors "T" shaped extension 24*a* engaging with the stake's 23 "T" shaped slot 23*b*.

Figure 11:
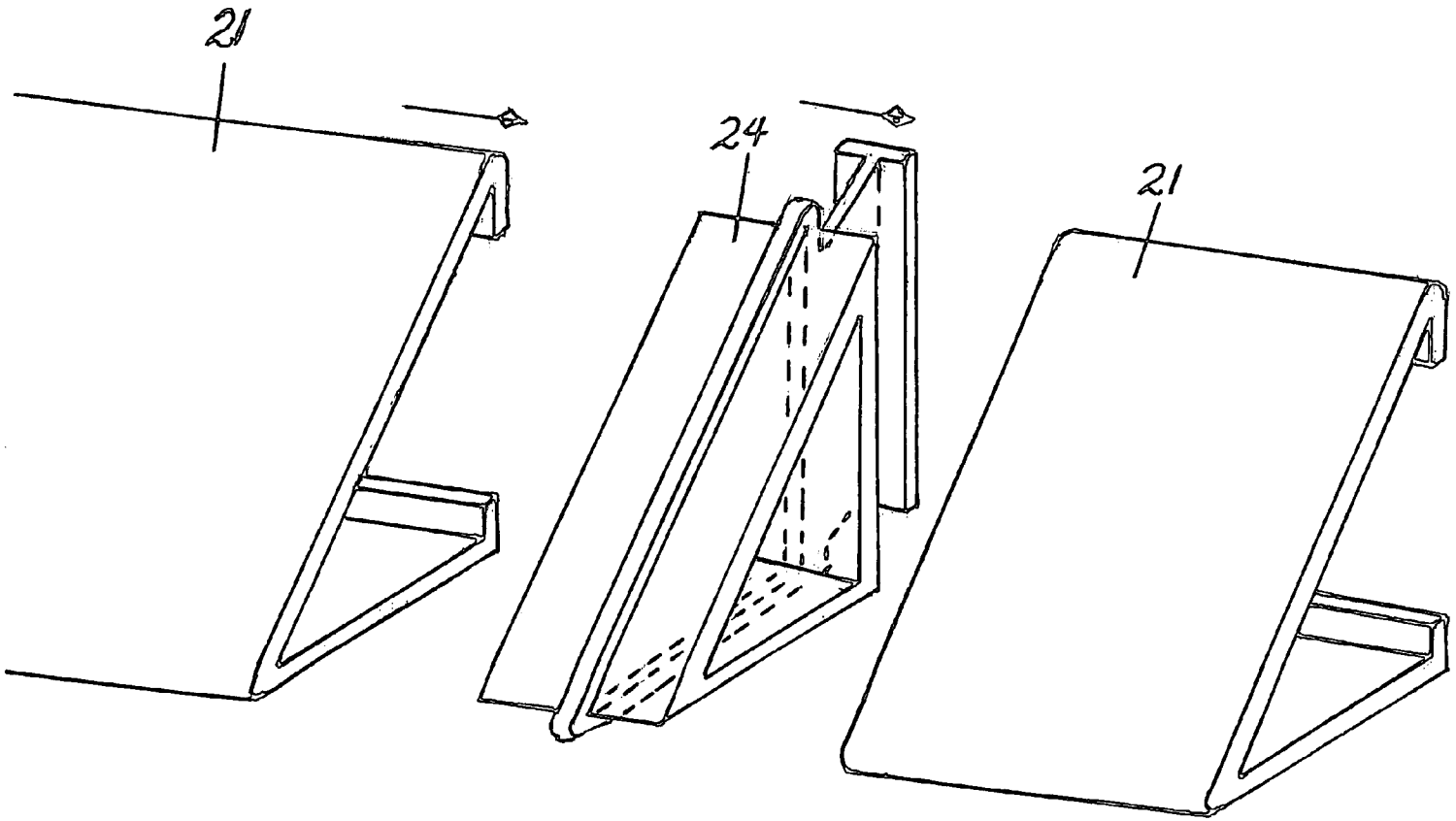
FIG. 11 is a perspective view showing how the connector works with the bevel forming members.

FIG. 11 shows a perspective view showing the connector member 24 can be used to connect two (2) lengths of straight bevel member 21, or a straight bevel 21 connecting to a corner bevel 22.

Figure 12:
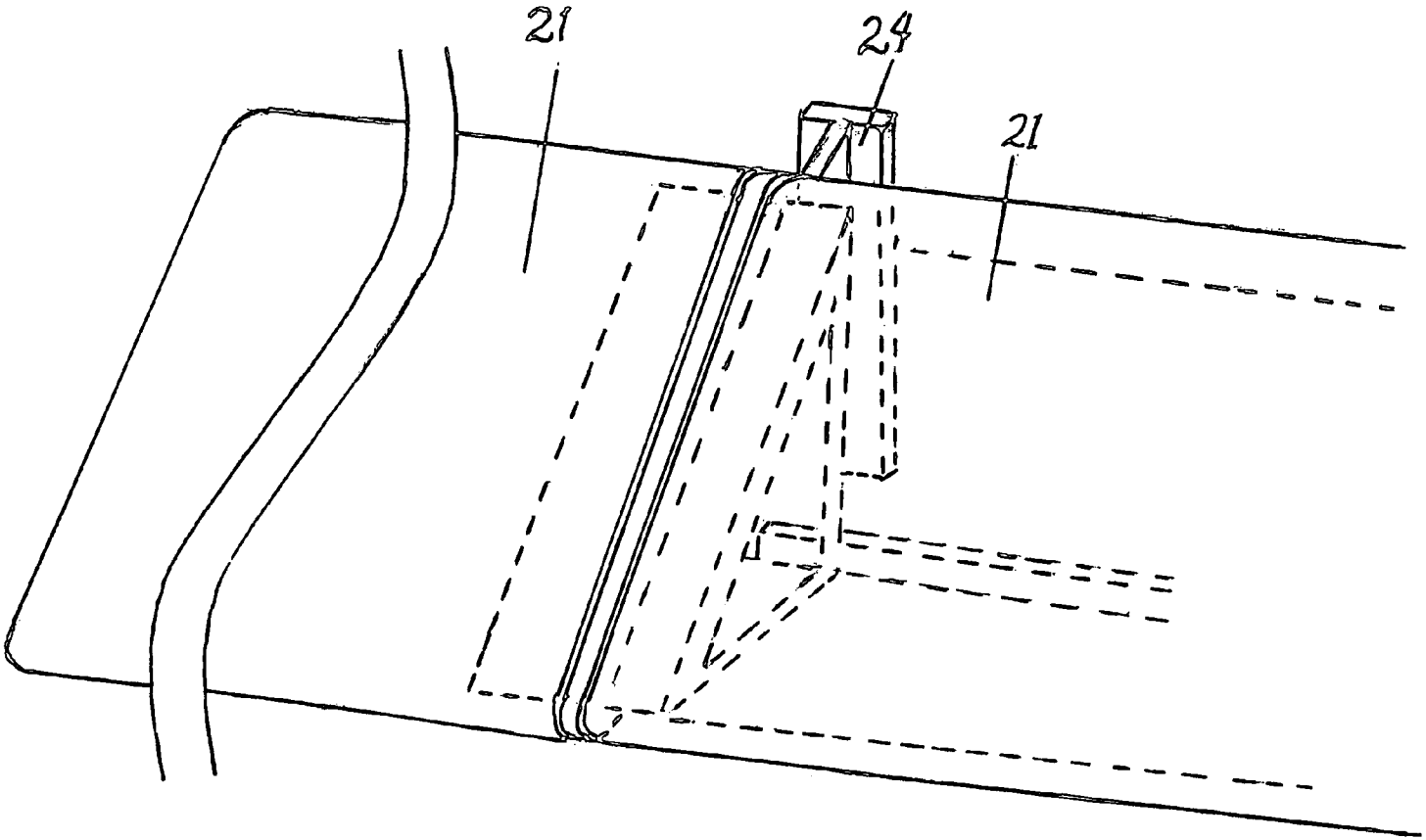
FIG. 12 is a perspective view showing continuing action of FIG. 11

FIG. 12 show a perspective view showing a completed connection of connector member 24 with two lengths of straight bevel member 21.

Figure 13:
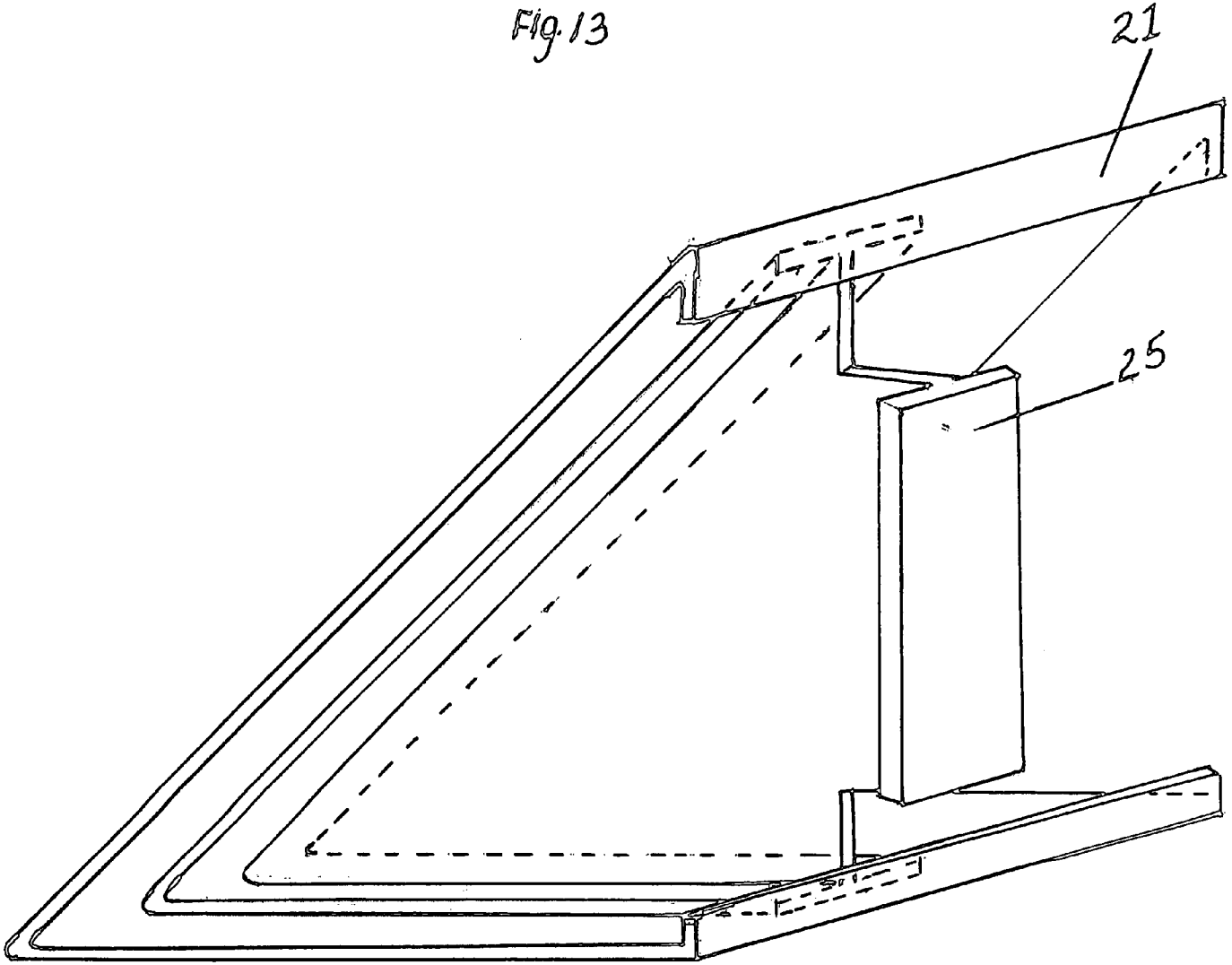
FIG. 13 is a perspective view of how the brace and the elongated bevel member works together.

FIG. 13 shows a perspective view of the angel brace 25 being used with a straight bevel member 21. The angle brace 25 is placed inside the straight bevel member 21 about every 24 inches in order to prevent the straight bevel member 21 from sagging to less than 45° degree angle.

OPERATION

FIGS. 1-13

The best way to realize the maximum benefit from the present invention is to make some small but important changes to the way fill-dirt 28 is handled in the perimeter form 26.

The usual way of handling the fill-dirt question is to fill the entire perimeter from 26 to within a few inches of the slab thickness level. For example, if the building plans specify a four (4) inch slab thickness, the perimeter form may be filled to within five (5) inches of the top of the perimeter form. The missing one (1) inch of fill-dirt comes from the trench excavation. Excess dirt is removed from the perimeter form.

Operating the present invention when the present invention is used, the perimeter form 26 should only be filled to within ten (10) inches of the top of the perimeter form for a four (4) inch thick slab. After the desired level, 10 inches from the top of the perimeter form has been reached, the fill-dirt 26 is leveled. The bevel forming device is then installed.

A good overall understanding of the device can be obtained by looking at FIG. 1. The illustration in FIG. 1 shows that the invention is comprised of only two (2) structural or main members straight, elongated member 21 and a corner member 22. These two (2) members, 21 and 22 form a boxlike enclosure whose sides as well as corners are sloped inwardly at a 45° degree angle.

The three smaller, fastener type member can be seen in FIG. 2 which shows a slotted ground stake 23. A connecting member 24, and an angle bracing member 25. The connecting member 24 is used to connect member 21 or member 22 or member 21 to member 21. The angle brace 25 is used to internally support member 21 so as to prevent sagging and maintain a perfect 45° degree bevel.

The general way that the invention is used is shown in FIG. 3 which shows a perimeter form 26 that has been filled with fill-dirt 28. The device is precisely laid out within the perimeter form 26.

The cross-section view is seen in FIG. 4 which shows the device laid out and ready for the trench to be dug. The finished trenches are shown in FIG. 5. The trenches were dug and the fill-dirt 28, and excavated earth 27 was used to fill the boxlike device. At this point the device has been successfully deployed.

The perspective view of FIG. 6 shows the same point in development as FIG. 5. When the trenches have been dug and the fill-dirt 28 and excavated 27 have been used to completely fill the volume of said device, with said device also being screeded; the device at this point has been fully and successfully installed.

The perimeter form 26 has been filled with cement 30 in FIG. 7. After the cement has hardened as shown in FIG. 8, the perimeter form 26 is removed.

The three small members of the device are shown in a perspective view in FIG. 9. The stake 23 has a "T" shaped slot down its length. The slot of the stake was designed to engage with the "T" shaped extension on both the connecting member 24 and the angle bracing member 25.

The actual engagement of the stake 23 and the connecting member 24 is shown in FIG. 10.

The connecting members 24 role in connecting the elongated members 21 to each other is shown in FIG. 11. The connecting member 24 also connects the straight member 21 to the corner member 22.

The completed connection between the two straight, elongated members 21 as shown in FIG. 12. In the perspective view of FIG. 13, the straight, elongated member 21 is shown being supported internally by the angle brace 25. The angle bracing member 25 is to be inserted into the elongated member 21 about every 24 inches along the length of said elongated member 21.

The bevel forming device can be easily manufactured. If the device is made of plastic the straight elongated member 21 can be extruded in 8 ft.-10 ft. lengths. The corner member 22 can be injection molded or cut from straight elongated 21 stock and ultrasonically welded. The stake 23 is extruded and the connection member 24 and the angle brace 25 can be injection molded.

From the operational description above, it becomes evident that the present invention accomplishes its four primary objectives:

1. Provide a device that will allow the user to install a 45° degree bevel into a foundation trench thereby making the entice foundation stronger.
2. Provide a device that when used correctly automatically causes the foundation to become compliant with the International Code Council rules.
3. Provide a device that makes foundation construction a faster process.
4. Provide a device that makes foundation construction an easier process.

CONCLUSION, RAMIFICATION, SCOPE

In reality, using our bevel forming device is as simple as the act of placing a box on the ground and filling that box with dirt. Our box is made up of corner members 22 and side members 21. The side and corner members are sloped inwards at 45° degree angle. The corner members and side members are held together by a connector member of the same profile. The perfect 45° degree angle is maintained in the elongated side member with a 45° degree angle keeping member. A specially designed stake is used with the connector member and the angle keeping member. The purpose of the stake is to prevent any lateral movement of our box. When our boxes have been correctly laid out, filled, packed and screeded, the bevel forming device has been successfully installed.

Our invention was designed to be used primarily on foundations for residential building, but our invention can be used in commercial construction that requires a 45° degree bevel in the trench.

The biggest problem of the American home building industry is poorly built foundations. Although every home builder is aware of the required 45° degree bevel, very few home builders comply with the rule because of the difficulty of carving or cutting a 45° degree bevel in fill-dirt. The knowledge of the 45° degree bevel's role in making foundations stronger was discovered using solid, scientific engineering principles that require accurate measurements.

The people who actually dig the foundation trenches have not been trained and equipped to carve or cut an accurate 45° degree bevel in a foundation trench. Even if the attempt to cut a 45° bevel was made by a very skilled laborer, chances are the real angle in the trench bevel would vary along the entire length and width of the trench.

Without our bevel forming device in foundations of America's homes, the home builders, warranty companies, mortgage companies, banks, investment companies, Fannie Mae, HUD and the American home buyer will continue to suffer great financial loss due to poor, faulty foundations.

We claim:

1. A device for forming an oblique, beveled edge in the trench of a building's foundation, the device comprising:

a hollow, wedge shaped, open ended, horizontally elongated element having a cross-section, said elements cross-section forming a 45 degree angle;

a hollow, wedge shaped, open ended corner element having a cross-section and a base, said corner element's cross-section forming a 45 degree angle while said base of said corner element forms a 90 degree elbow;

a hollow, isosceles triangle shaped connecting joint having a vertical leg used for connecting said corner and elongated elements, said vertical leg having a T-shaped extension;

a flattened, isosceles triangle shaped bracing element having a base edge, a slant edge and a vertical edge, said bracing element's base edge and slant edge having a perpendicular, T-shaped addition to provide vertical balance, with said vertical edge of the triangle having a T-shaped extension;

a rectangle shaped stake having a length and a T-shaped slot running the entire length of the stake; said slot is designed to fit the T-shaped extension of the connecting joint and the bracing element.

* * * * *